US009511895B2

(12) United States Patent
Cohen

(10) Patent No.: US 9,511,895 B2
(45) Date of Patent: Dec. 6, 2016

(54) PACKAGE ASSEMBLY, IN PARTICULAR A RETURNABLE TYPE PACKAGE ASSEMBLY

(75) Inventor: Plutarco Cohen, Bella Vista (PA)

(73) Assignee: FREE PACK NET HOLDING SAGL, Lugana (CH)

( * ) Notice: Subject to any disclaimer, the term of this patent is extended or adjusted under 35 U.S.C. 154(b) by 2054 days.

(21) Appl. No.: 11/547,569

(22) PCT Filed: Apr. 12, 2005

(86) PCT No.: PCT/IB2005/000957

§ 371 (c)(1),
(2), (4) Date: Oct. 6, 2006

(87) PCT Pub. No.: WO2005/100181

PCT Pub. Date: Oct. 27, 2005

(65) Prior Publication Data

US 2007/0221670 A1 Sep. 27, 2007

(30) Foreign Application Priority Data

Apr. 13, 2004 (IT) ..... MI2004A0727

(51) Int. Cl.
*B65D 6/00* (2006.01)
*B65D 6/24* (2006.01)
*B65D 6/38* (2006.01)

(52) U.S. Cl.
CPC ..... *B65D 11/1866* (2013.01); *B65D 11/24* (2013.01)

(58) Field of Classification Search
USPC ..... 220/4.28, 621, 632, 62.19, 607–609, 220/626, 636, 23.4; 206/509, 386, 821, 206/521, 508
See application file for complete search history.

(56) References Cited

U.S. PATENT DOCUMENTS

| | | | | | |
|---|---|---|---|---|---|
| 2,787,407 | A | * | 4/1957 | Lang | 248/346.01 |
| 3,283,992 | A | * | 11/1966 | Hanson et al. | 383/32 |
| 3,474,928 | A | * | 10/1969 | Hurtt | 206/508 |
| 3,490,583 | A | * | 1/1970 | Cook | 206/386 |
| 3,519,163 | A | * | 7/1970 | Bardell | 206/508 |
| 3,616,943 | A | * | 11/1971 | Brink | 206/508 |
| 3,771,689 | A | * | 11/1973 | Mejan, Jr. | 220/632 |
| 4,050,604 | A | * | 9/1977 | Flanders | 220/4.28 |
| 4,155,451 | A | * | 5/1979 | Miller | 206/503 |
| 4,655,360 | A | * | 4/1987 | Juhanson | 220/632 |
| 4,753,831 | A | * | 6/1988 | Hosoyamada et al. | 428/34.2 |
| 5,131,212 | A | | 7/1992 | Grey et al. | |
| 5,146,732 | A | | 9/1992 | Grey et al. | |

(Continued)

FOREIGN PATENT DOCUMENTS

| | | |
|---|---|---|
| DE | 1 960 113 | 6/1971 |
| DE | 92 01 608.1 U1 | 4/1992 |

(Continued)

*Primary Examiner* — Shawn M Braden
(74) *Attorney, Agent, or Firm* — Pearne & Gordon LLP

(57) ABSTRACT

The present invention relates to a returnable package a comprises confining elements (2) that can be mutually assembled in a removable manner to define a holding volume, said confining elements having interfacing surfaces (2*a*) designed to be in mutual contact when two or more packages (1) are under piling-up and/or side-by-side relationship conditions; the package further comprises grip means (3) associated with the interfacing surfaces of the confining elements, the grip means being disposed in a matrix scheme defining directrices (4) intersecting at least two directions of possible relative sliding (5) that are mutually transverse and lie on the interfacing surfaces.

21 Claims, 10 Drawing Sheets

(56) References Cited

U.S. PATENT DOCUMENTS

| | | | | |
|---|---|---|---|---|
| 5,247,747 | A | 9/1993 | Grey et al. | |
| 5,423,452 | A * | 6/1995 | Tardif | 220/574 |
| 5,456,061 | A | 10/1995 | Grey et al. | |
| 5,469,691 | A | 11/1995 | Grey et al. | |
| 5,542,237 | A | 8/1996 | Grey et al. | |
| 5,642,830 | A * | 7/1997 | Foster | 220/4.28 |
| 5,794,414 | A | 8/1998 | Grey et al. | |
| 6,131,376 | A | 10/2000 | Grey et al. | |
| 6,471,402 | B1 * | 10/2002 | Burns | 383/32 |
| 2003/0034349 | A1 * | 2/2003 | Frey | 220/632 |
| 2007/0122581 | A1 * | 5/2007 | Perez Carballo | 428/40.1 |

FOREIGN PATENT DOCUMENTS

| | | |
|---|---|---|
| EP | 0 525 623 A1 | 2/1993 |
| JP | 08198271 | 8/1996 |
| WO | WO 91/06477 | 5/1991 |

* cited by examiner

FIG 3
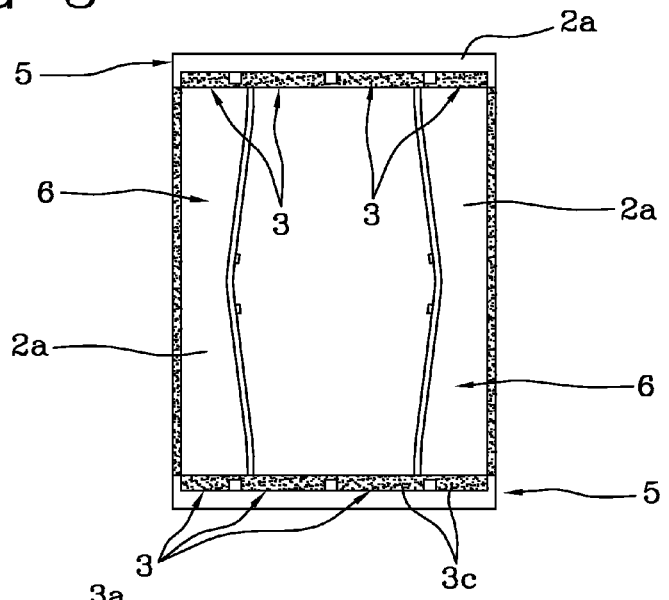
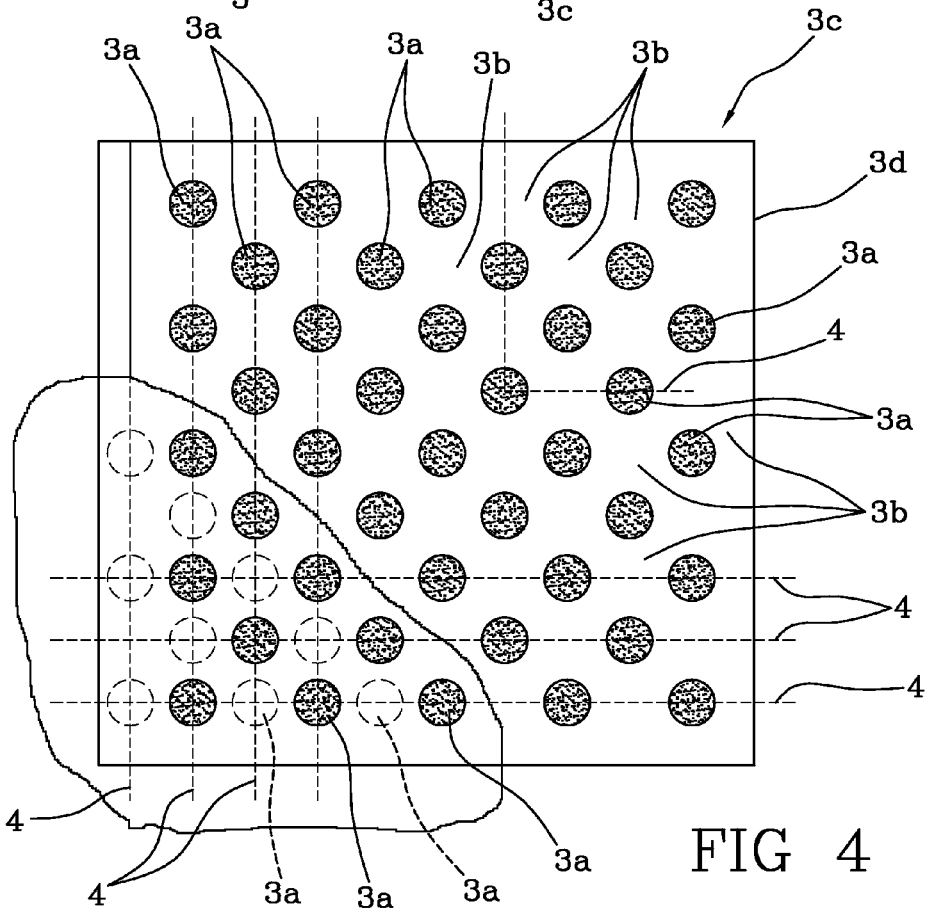
FIG 4

PACKAGE ASSEMBLY, IN PARTICULAR A RETURNABLE TYPE PACKAGE ASSEMBLY

The present invention relates to a returnable package, i.e. a package to be employed for goods transportation which can be re-used and/or sent back to the consignor once emptied of its contents, for subsequent loading.

It is known that the so-called "returnable packages" are widely used for transportation and/or storage of any type of goods and for example apply to the sector of the so-called industrial and service packaging (in which sector the re-usable packages are employed to contain a plurality of items or smaller containers).

In the general structure of these packages the presence of different constituent elements is provided, which elements are mutually assembled around the product to be stored or transported or are first assembled and subsequently filled with the product.

It is also to be noted that the different types of containers presently used in warehouses and/or in goods carriers, either if they are of the "disposable" type or of the "returnable" type, must meet predetermined requirements in terms of handiness (through use of lift trucks of different types) and in terms of structural coherence.

In the first case, two or more packages disposed in horizontal side by side relationship with each other are required to be laterally grasped by particular types of lift trucks, currently referred to as "jaw lift trucks" which act on the side faces of the packages and press them against each other; in this manner friction generated on the side faces of the packages in mutual contact enables lifting and handling of a coherent package assembly.

In the second case, a plurality of piled up (or otherwise stored) packages in a warehouse must be able to keep an intrinsic steadiness, avoiding slipping and/or relative displacements between the piled up packages (which displacements for example can be generated in response to vibrations induced by passage of heavy transport means such as railway trucks or articulated lorries through the warehouses) that can lead to clear risks of collapse of the piled up packages, which will obviously have repercussions in terms of safety of the staff present in these working areas.

All packages that are presently most widely spread have very serious drawbacks as regards the different use situations.

For instance, since traditional "disposable packages" (made of paperboard/expanded polystyrene/wood) are produced with materials having rather poor structural-strength features, they often force the goods that are to be introduced thereinto to be oversized, so that the goods themselves must bear either the strong lateral-compression stresses imposed by the "jaw" lift trucks, or the strong vertical-compression stresses resulting from piling up of several packaged items. It is therefore apparent that the intrinsic "mechanical inadequacy" of these traditional packages adversely affects the packaged products that will be much heavier than necessary and therefore more expensive.

In addition, presently known containers can have insufficient cohesion features under conditions of "multiple grip" (i.e. in the operating conditions involving grasping and handling of several package rows that must also be superposed), above all when the packaged goods are very heavy and when a great number of packages must be handled by means of the so-called jaw lift trucks. In fact, under these conditions the innermost containers must not be sufficiently retained by friction (which friction is generated as a consequence of the pressure exerted by the jaws of said lift truck) and therefore may have a tendency to slip downwards; once more this involves important risks connected with the possibility of damaging the goods and impairing safety of the work environment.

It is to be noted that also the relative movements between several packages can be dangerous not only during handling of same, but also when the packages are maintained under piling-up conditions (for example, in a shed or the loading compartment of a transport means); in fact it is possible that, due to different factors (particular shapes of the packaged goods, particular vibration or movement conditions of the transport means, and so on) the piled-up packages will tend to shift relative to each other.

A further drawback of the packages of known type (and more particularly the packages to be thrown away after use) is represented by waste disposal that has become a reason of serious worry bath for social workers and for goods manufacturers; in fact, traditional "disposable" packages (consisting of box-shaped elements made of paperboard inside which the goods are stored, which goods can be protected by a series of shock-resistant shells made of expanded polystyrene or the like) in addition to not being very performing from the point of view of protection of the article of manufacture and of being much bulkier, are also of difficult disposal, above all in view of the recent rules (such as rules 94/62/EC, 2004/12/EC, by which the European Community states the targets for recovery and recycling of package waste until the year 2008, or document "Green Paper—Integrated Product Policy" of Feb. 7, 2001, introducing the concept of product planning and package integration from a sustainability point of view).

Therefore the present invention aims at providing a package and more particularly a package of the returnable type capable of obviating the above stated limits.

In more detail the present invention aims at making available a returnable package that is able to efficiently carry out structural tasks, so that it can absorb both "static" loads (occurring under piling-up and/or handling conditions) imposed by handling devices such as jaw lift trucks or lift trucks of any other type, and "impulse" loads originating from possible falls and/or shocks (thus avoiding resorting to oversizing of the items to be packaged and transported).

In addition, the present invention aims at providing a returnable package that, under conditions of mutual piling-up/side by side relationship with other packages of the same type forms a coherent assembly of high steadiness, or in other words, does not tend to move from the piled-up/side by side relationship condition.

It is also to be noted that the present invention aims at providing a returnable structural package enabling exploitation of the logistic transportation spaces (railway trucks, lorry trailers, and others) and/or storage spaces (vertical saturation of warehouses, sheds and so on) to be maximised; this aim can be achieved by minimising the "empty" spaces existing between the package and the goods, and finally results in general abatement of the costs not only connected with the logistic aspects (increase in the number of the stored articles of manufacture per square meter and/or increase in the saturation coefficient of the transport means), but also with the whole process concerning planning and manufacture of the package and even of the goods to be packaged therein.

A still further aim of the invention is to make available a returnable package having such a geometry that an optimal use of the logistic spaces is allowed and at the same time relative displacements between several packages of the same type under conditions of mutual piling-up/side by side relationship are prevented, irrespective of the shape of the items contained in the packages and/or without considering possible external trouble factors.

A no less important aim of the invention is to conceive a returnable package to be manufactured at low costs, with materials having a low environmental impact and a prolonged useful life, which is also of easy assembling and disassembling before and after use, and can be easily stored and transported in a reduced space.

The foregoing and further aims that will become more apparent in the following of the present description are substantially achieved by a returnable package having the features shown in one or more of the appended claims.

By way of explanation of the present inventive idea, an embodiment of a returnable package in accordance with the present invention will be given hereinafter by way of non-limiting example and illustrated in the accompanying drawings, in which:

FIGS. 1*a*, 1*b*, 2*a* and 2*b* show exploded views of two different alternative embodiments of the package in accordance with the present invention;

FIG. 3 is a side view of a package as shown in FIG. 1 or 2, in an assembled arrangement;

FIG. 4 shows a detail of the grip means associable with a first package, with a portion in chain line representing the grip means of a second package disposed close to the first one;

DETAILED DESCRIPTION OF THE INVENTION

Figure 1A:
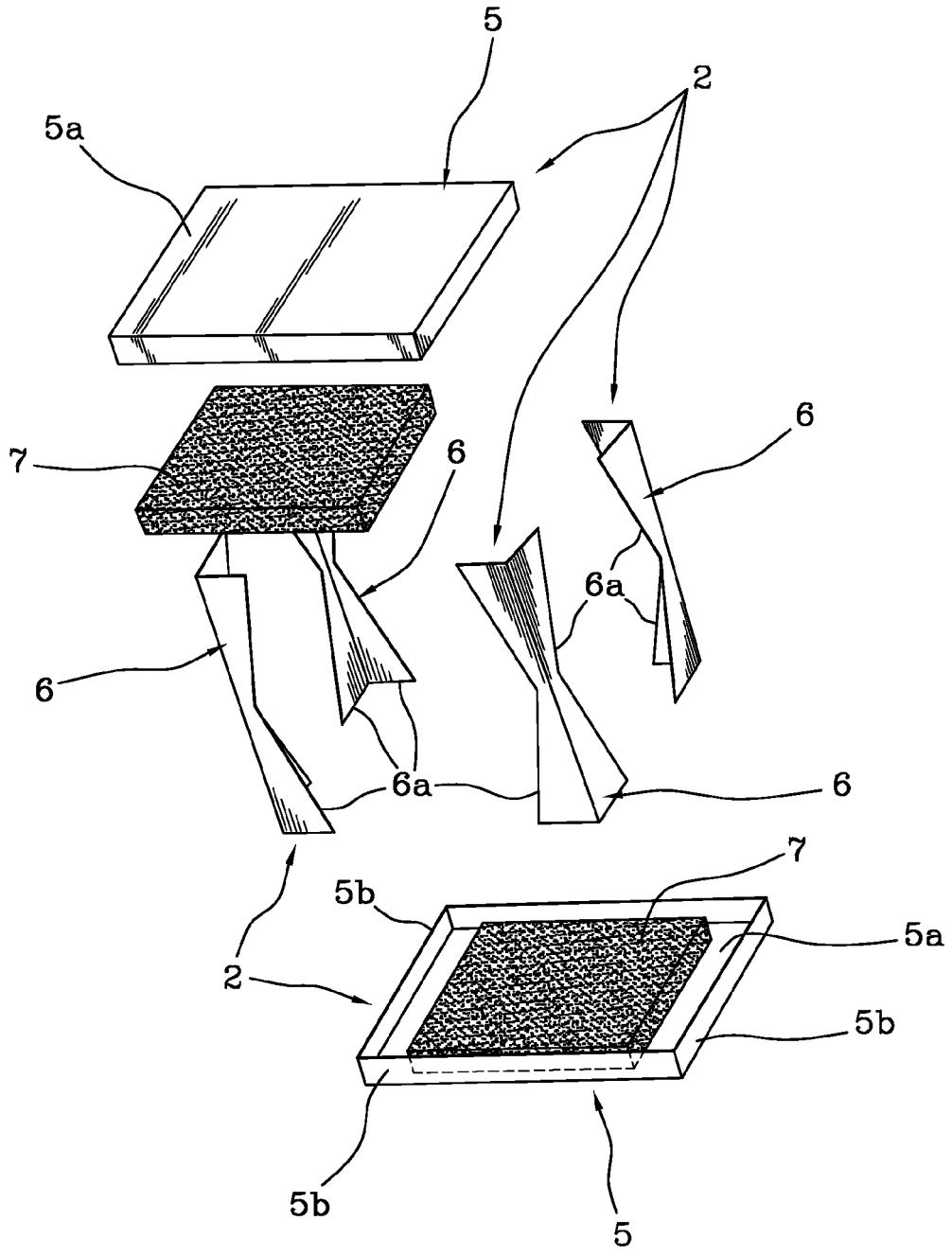

With reference to the accompanying drawings, the package in accordance with the present invention is generally identified by reference numeral 1 and substantially comprises a predetermined number of confining elements 2 to be mutually and removably assembled to define a holding volume.

The confining elements 2 can be of any number and arrangement, provided they are adapted to contain at least one given type of items or goods, and have a corresponding number of interfacing surfaces 2*a* designed to be in mutual contact when two or more packages 1 are under conditions of piling up and/or side by side relationship (as it may happen during handling of one or more package rows or during storage in a shed, for example).

Advantageously, the present package further comprises grip means 3, present on the interfacing surfaces 2*a* of the confining elements 2; this grip means 3 is disposed in a matrix scheme in turn defining directrices 4 that extend so as to intersect at least one and preferably two directions of possible relative sliding that are mutually transverse and lie on the interfacing surfaces 2*a*.

In this manner, when two or more packages are disposed close to each other (at least at one of their interfacing surfaces 2*a* that substantially appear to be the outer surfaces of the confining elements 2), the grip means 3 mutually interacts so as to prevent one of the two packages from sliding relative to the other.

The grip means also 3 generates additional constraining reactions with respect to the friction reactions generated on the interfacing surfaces 2*a*; the relative orientation of the vectors of these constraining actions resulting from mutual approaching of particular structures of the grip means (to be described in the following) is advantageously connected with arrangement of the grip means along the directrices 4 which, suitably set, will make quite impossible any relative sliding between two packages 1 disposed close to each other along any direction lying in the contact plane of the packages.

In accordance with the present invention, the directrices 4 comprise a predetermined number of angles and/or a predetermined number of curvilinear stretches (circular, elliptic or in any case mixtilinear stretches, depending on specific requirements); these curvilinear stretches and/or angles are suitably disposed in predetermined successions; in addition, still in accordance with the present invention a plurality of directrices 4 disposed in side by side relationship can be arranged, which directrices are preferably mutually parallel, within the above mentioned matrix scheme.

In the accompanying figures there are some examples of these directrices where, in the different cases shown, it is possible to see several concentric circular lines or broken lines describing given angles; it is also possible that some or all of these lines will have intersection points or, in other words, one and the same element belonging to the grip means 3 can be simultaneously disposed on two or more directrices 4.

Conveniently, in order to exert the above mentioned constraining reactions, the grip means 3 comprises engagement protrusions 3*a* distributed along the directrices 4; the engagement protrusions 3*a* of a first package 1 interface with the corresponding grip means 3 of a second package 1 disposed in side by side relationship with the first one, generating constraining reactions that will be directed transversely of the directrices 4.

It is therefore apparent the a suitable arrangement of the directrices 4 will give rise to constraining reactions such directed as to prevent relative sliding of the two packages in any direction on one of the two interfacing surfaces 2*a*.

From a structural point of view, the engagement protrusions 3*a* have an extension axis emerging from one of said interfacing surfaces 2*a* and can have any shape provided it is suitable for interfacing with corresponding engagement protrusions 3*a* belonging to another package 1.

Advantageously, in order to facilitate the handling/compacting/storage operations, self-centring means is also present which is operatively active between the grip means 3 of at least two packages 1 disposed in mutual side by side relationship or mutually piled up; conveniently, the self-centring means is integrally formed at least on the engagement protrusions 3*a* to enable mutual interfacing of same. In other words, the conformation of the engagement protrusions 3*a* can be defined in such a manner that the engagement protrusions 3*a* belonging to different packages can penetrate into each other at least partly and at the same time can spontaneously reach a steady configuration capable of generating the appropriate constraining reactions.

According to an embodiment of the present invention, the engagement protrusions 3*a* have a tapered shape along their extension axis; this tapered shape can result from a frusto-conical configuration, a truncated-pyramid configuration or an at least partly spheroidal configuration. It will be appreciated that the just described shapes (given for purposes of illustration and not of limitation) enable achievement of the technical effect of self-centring means, since two protrusion arrays 3*a* thus shaped can be mutually approached and when the respective side surfaces of the protrusions come into contact, the protrusions will guide each other so as to reach a precise positioning of the confining elements 2 (and, as a result, of packages 1).

It is also possible for the self-centring means to be made in other different ways and for the protrusions 3*a* to have different shapes; for instance, the engagement protrusions 3*a* can have a cylindrical shape along their extension axis.

To further improve coupling between two packages disposed close to each other, the grip means 3 can further comprise engagement recesses 3*b* the shape of which matches that of the engagement protrusions 3*a* at least partly; advantageously, these engagement recesses 3*b* can be disposed along the directrices 4 preferably alternated with the engagement protrusions 3*a* (and in this manner can be engaged by the protrusions 3*a* of another package, thereby increasing steadiness of the mutual connection between two approached packages and also further increasing the self-centring effect).

The engagement recesses 3*b* can be merely defined in the space included between at least two engagement protrusions 3*a* or, depending on requirements, can be formed in the confining elements 2 following more complicated structures; for instance, the engagement recesses 3*b* can have an extension axis entering the interfacing surface and preferably consist of a frusto-conical cavity, a cavity in the form of a truncated pyramid or an at least partly spheroidal cavity (the shape of which can advantageously match that of the engagement protrusions 3*a* at least partly).

Obviously, should the protrusions 3*a* be of cylindrical shape, the engagement recesses 3*b* too will in turn consist of cylindrical cavities.

Generally, it is to be pointed out in any case that the grip means 3, during the handling operations with forklift trucks provided with jaws for multiple grip (or also of single grip depending on the operating requirements) ensures fitting coupling of several containers disposed in side by side relationship preventing downwards sliding of the containers themselves during lifting.

The protrusions 3*a* and/or recesses 3*b* can be advantageously disposed on concentric directrices 4 and can be distributed on the whole interfacing surface 2*a* (or outer surface) of one or more confining elements 2.

In accordance with a further feature of the present invention, the grip means 3 is formed into groups of sectors 3*c* delimited by predetermined contours 3*d*; for instance, with reference to the accompanying figures it is possible to see that these sectors 3*c* can be distributed according to a given space scheme (to be determined according to specific requirements, as detailed in the following). Sectors 3*c* practically delimit the regions on the interfacing surfaces where the grip means 3 is located.

Within sectors 3*c*, the grip means 3 itself is disposed according to a matrix scheme that can be different for each individual sector 3*c* or ideally repeated in each sector 3*c*; in order to ensure the greatest possibility of mutual approaching and engagement for two packages 1, the matrix scheme described by the grip means will be preferably the same for all sectors 3*c* of two interfacing surfaces 2*a* designed to approach each other under piling up/packing conditions, in such a manner that mutual meshing of two sectors accommodating a given distribution of protrusions 3*a* and/or recesses 3*b* does not hinder a simultaneous mutual meshing of different sectors 3*c*. The edges 3*d* can have any shape (see the accompanying figures, for example), depending on requirements.

Optionally, the grip means 3 may comprise elongated protrusions 3*a* disposed parallel to each other and preferably gathered within suitably located and delimited sectors 3*c*. Within the scope of the present invention, still more preferably the elongated protrusions 3*e* belonging to different sectors 3*c* are parallel to each other, again for the purpose of improving mutual and simultaneous meshing of several protrusion/recess sectors present on the same interfacing surface 2*a*. Conveniently, the just described elongated protrusions 3*e* operate following the same principle previously illustrated and can be conceived in such a manner as to achieve a self-centring effect.

Depending on the different types of items/goods to be packaged, the confining elements 2 can be of any number and conformation, and the grip means 3 can be disposed with great freedom of choice on the respective interfacing surfaces 2*a* of one or more of the confining elements 2*a*.

In an embodiment of the present invention, the confining elements 2 comprise at least one base element 5 (that can be conveniently associated with a bottom portion or a top portion of an item to be packaged); this base element 5 has a main wall 5*a* (designed to constitute the package bottom or top) having a predetermined edge and secondary walls 5*b* emerging from the main wall 5*a* at the sides of said edge.

Conveniently, the grip means 3 is formed on the outer surfaces of the main wall 5*a* and/or the secondary walls 5*b*; for instance, in the accompanying figures it is possible to see that on the main wall 5*a* there is the presence of grip means 3 disposed in two concentric series of sectors 3*d*, in which the protrusions 3*a* are disposed on substantially circular directrices (ideally going on from one sector to the other), while the secondary walls 5*b* have elongated protrusions 3*e* formed into groups of sectors 3*c* having quadrangular (rectangular, for example) edges 3*d*; these elongated protrusions 3*e* are disposed on the interfacing surface 2*a* of at least one of the secondary walls 5*b* and extend in a direction parallel to the edge of the main wall 5*a*.

In more detail, the base element 5 comprises a predetermined number of sectors 3*c* having grip means 3 on the interfacing surface 2*a* of the main wall 5*a* (but it is also possible to set these sectors 3*c* on at least one secondary wall, should it be necessary due to specific requirements); conveniently, these sectors 3*d* are formally divided into two groups the first of which comprises sectors disposed in the vicinity of the edge of the main wall 5*a* and the second of which comprises sectors disposed along an inner crown 5*c* arranged internally of the edge of the main wall 5*a* and at a substantially centred position relative to said main wall.

It is to be pointed out that the just described arrangement of sectors 3*d* is advantageous during manufacture of the main element 5 (which element can be for example obtained by moulding or injection moulding of plastic materials such as polypropylene or the like); actually, this arrangement of the grip means 3 enables balancing of the material masses during formation of the workpiece thus ensuring flatness of the main wall 5*a*.

It is to be pointed out that the achieved flatness enables a constant support to be obtained on at least three points of the package when the latter is handled on parallel conveyor belts; on the other hand, the presence of this type of "perfectly planar" support is important in order to avoid package 1 from rotating when it is handled by parallel rollers (in other words, the just described feature allows axial advancing and correct front orientation of package 1 relative to the roller conveyor or belt conveyor).

In a further alternative embodiment of the present invention, the base element 5 comprises elongated protrusions 3*e* disposed in sectors 3*c* having edges 3*d* of quadrangular (rectangular, for example) shape disposed in a matrix scheme on the interfacing surface 2*a* of the main wall 5*a*; in this case the elongated protrusions 3*e* extend in a direction transverse to at least one side of one of the edges 3*d* (so that they appear to be directed parallel to a diagonal of the main wall).

In order to better explain the present invention, it is pointed out that by the term "transverse" it is intended a direction or (real or ideal) line forming a given angle different from zero with the edge or corner of the main wall 5*a* and/or of at least one of the secondary walls 5*b*.

For assembly of package 1, the base element 5 further comprises means 9 for coupling with at least another confining element 2 (that will preferably be an upright 6 or a crosspiece or the like); this coupling means 9 will be of any type and may for example comprise a peripheral groove extending (at least partly) on the edges of the secondary faces 5*b* opposite to the edge of the main wall 5*a* (and/or on the face of the main wall 5*a* opposite to the interfacing surface 2*a*), which in turn is designed to receive, under operating conditions, an engagement abutment (belonging to the upright 6 or any other type of confining element 2) conforming in shape to the main wall itself at least partly.

In more detail as regards the embodiment of the package shown in the figures, the uprights 6 can be interposed between two base elements 5 so as to define a holding volume of a substantially prismatic shape and more preferably parallelepiped shape.

In this manner according to the present invention, a returnable package is obtained by use of an open "container" as the base/lid and a plurality of "load bearing columns" enabling coupling by fitting into the "base" and the "lid" (through the above described grooves or equivalent technical means).

Depending on the specific requirements, the uprights 6 will have any cross section and/or conformation; for instance, they can consist of section members having a hollow and closed section or a solid section.

Conveniently, at least one and preferably all of the uprights 6 seen in cross section consist of a thin wall and define a concavity in a direction transverse to a longitudinal extension axis of the upright itself (for instance, this cross section will have a V-shaped, L-shaped or more preferably C-shaped conformation).

The just described conformation of the uprights 6 allows a great compactness to be obtained when package 1 is dismantled; in fact, the uprights 6 thus shaped can be disposed in side by side relationship and superposed on each other and at the same time can be stored within two mutually-approached main elements 5 to form a box-shaped element (keeping the longitudinal inner angle of the "angular columns" as the support point); in this way a great reduction in the volume of the container for return transportation is obtained.

Figure 1B:
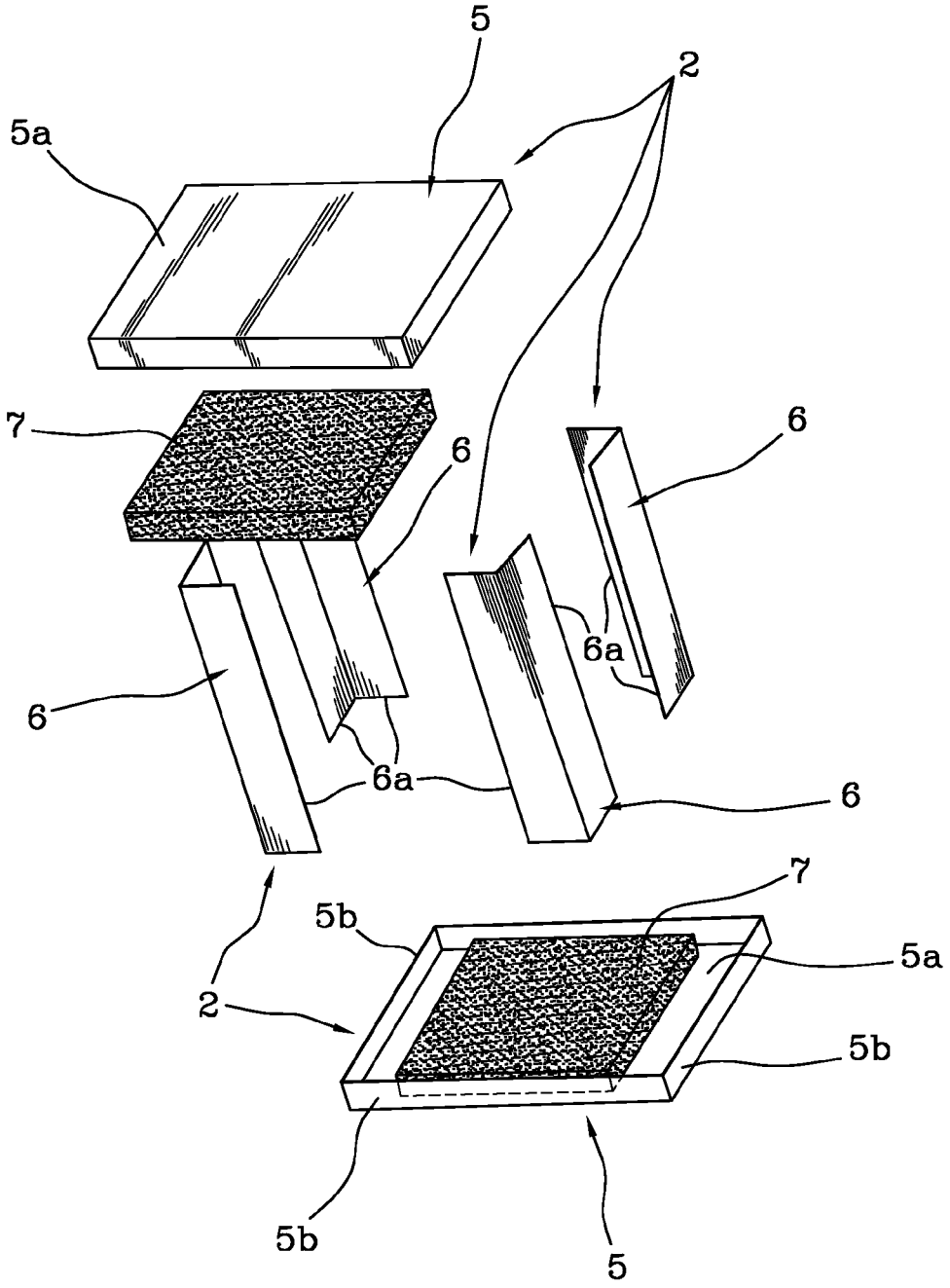
Figure 2A:
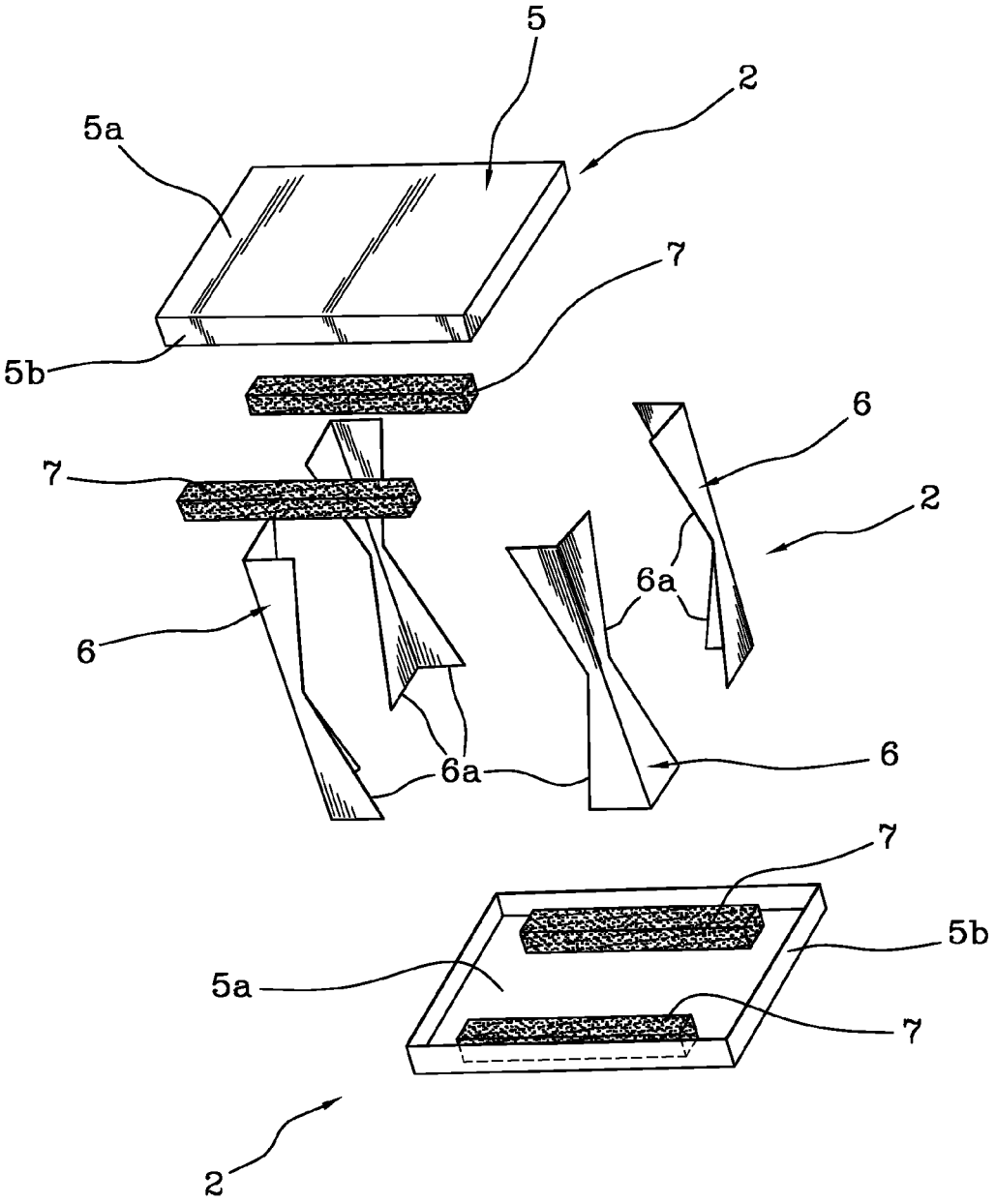
Figure 2B:
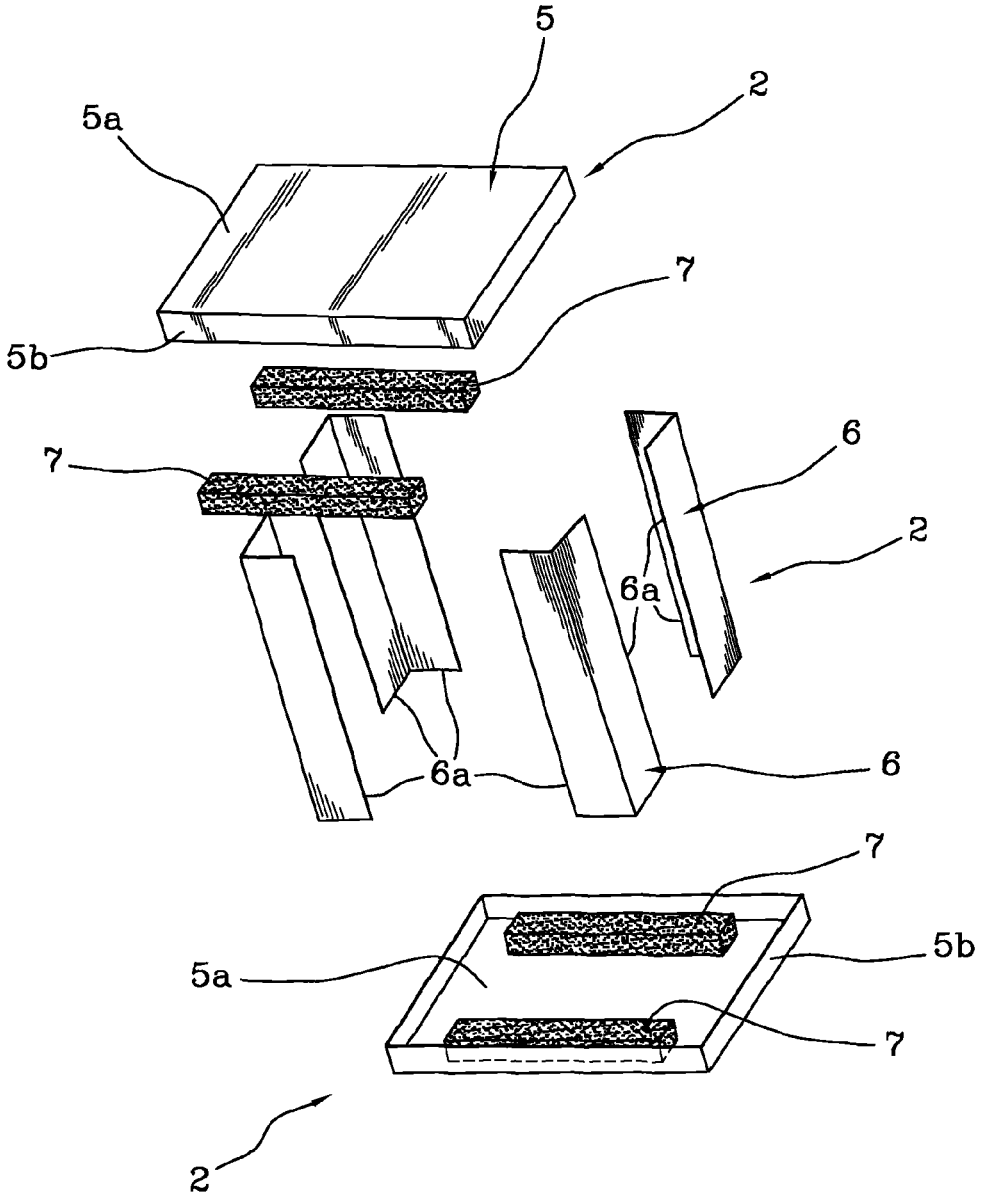
Figure 5:
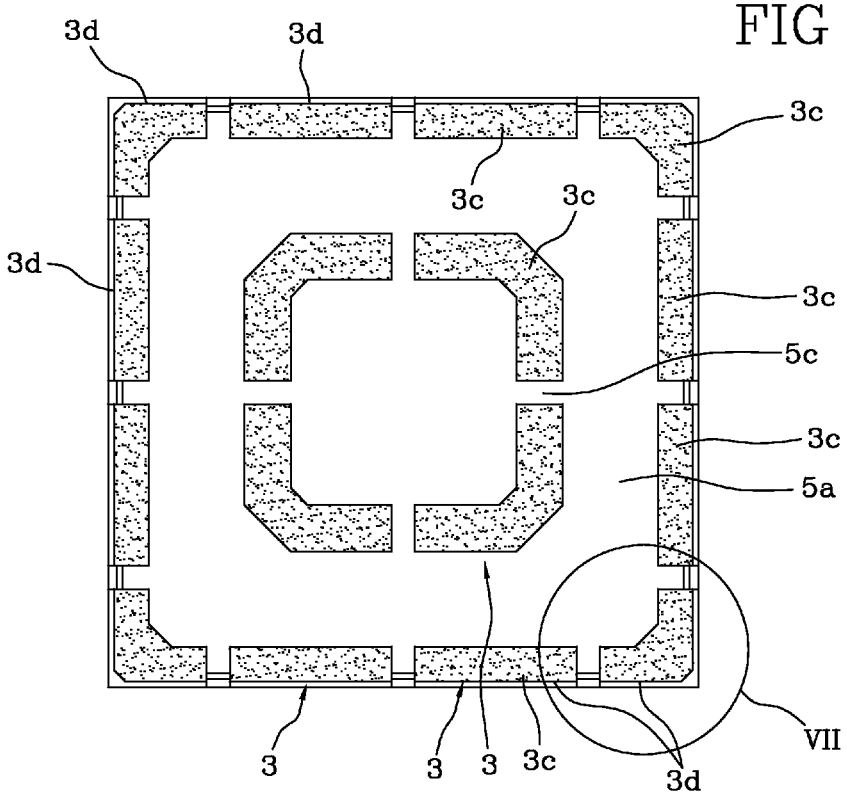
FIG. 5 is a plan view of an element of the package in accordance with the present invention.
Figure 6:
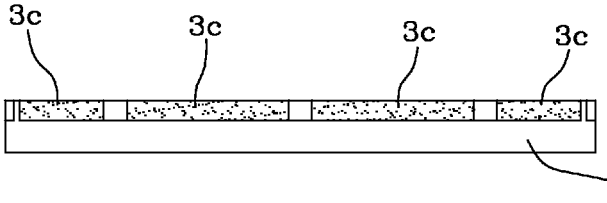
FIG. 6 is a side view of the element in FIG. 5.
Figure 7:
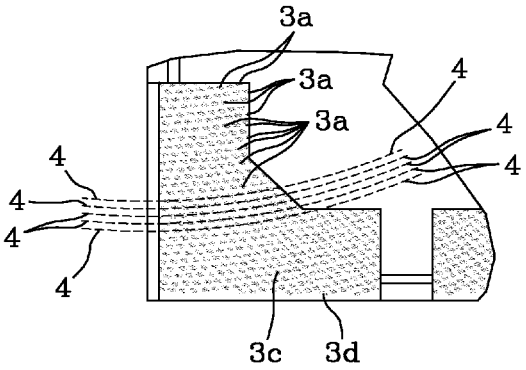
FIG. 7 shows portion VII in FIG. 5 to an enlarged scale.
Figure 8:
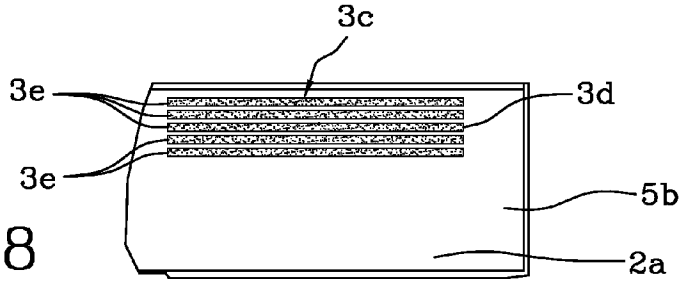
FIGS. 8, 9 and 10 show alternative embodiments of the grip means on the element in FIG. 5.
Figure 9:
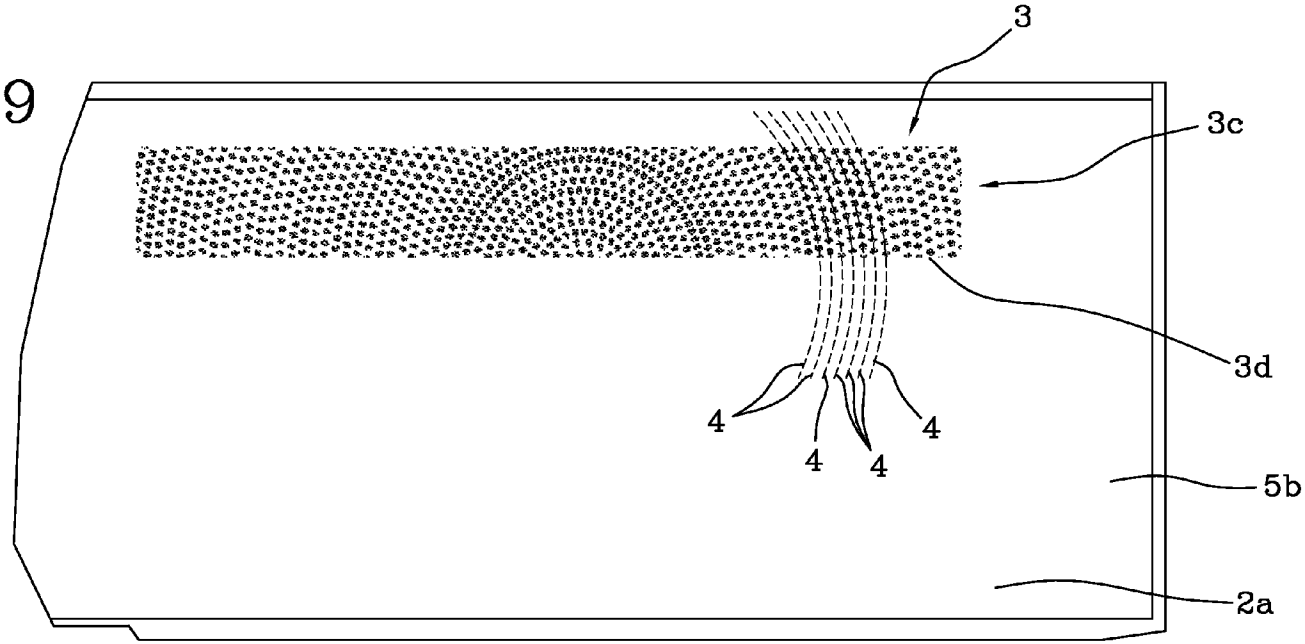
Figure 10:
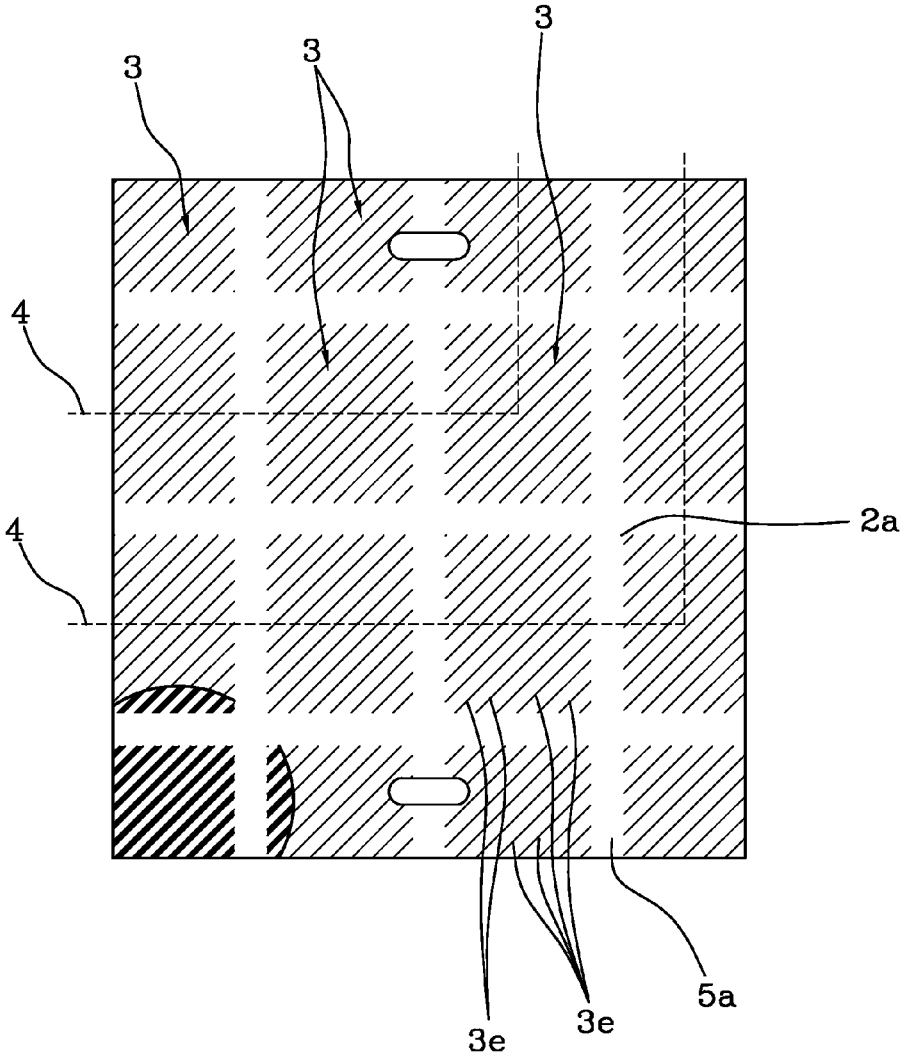
Figure 11:
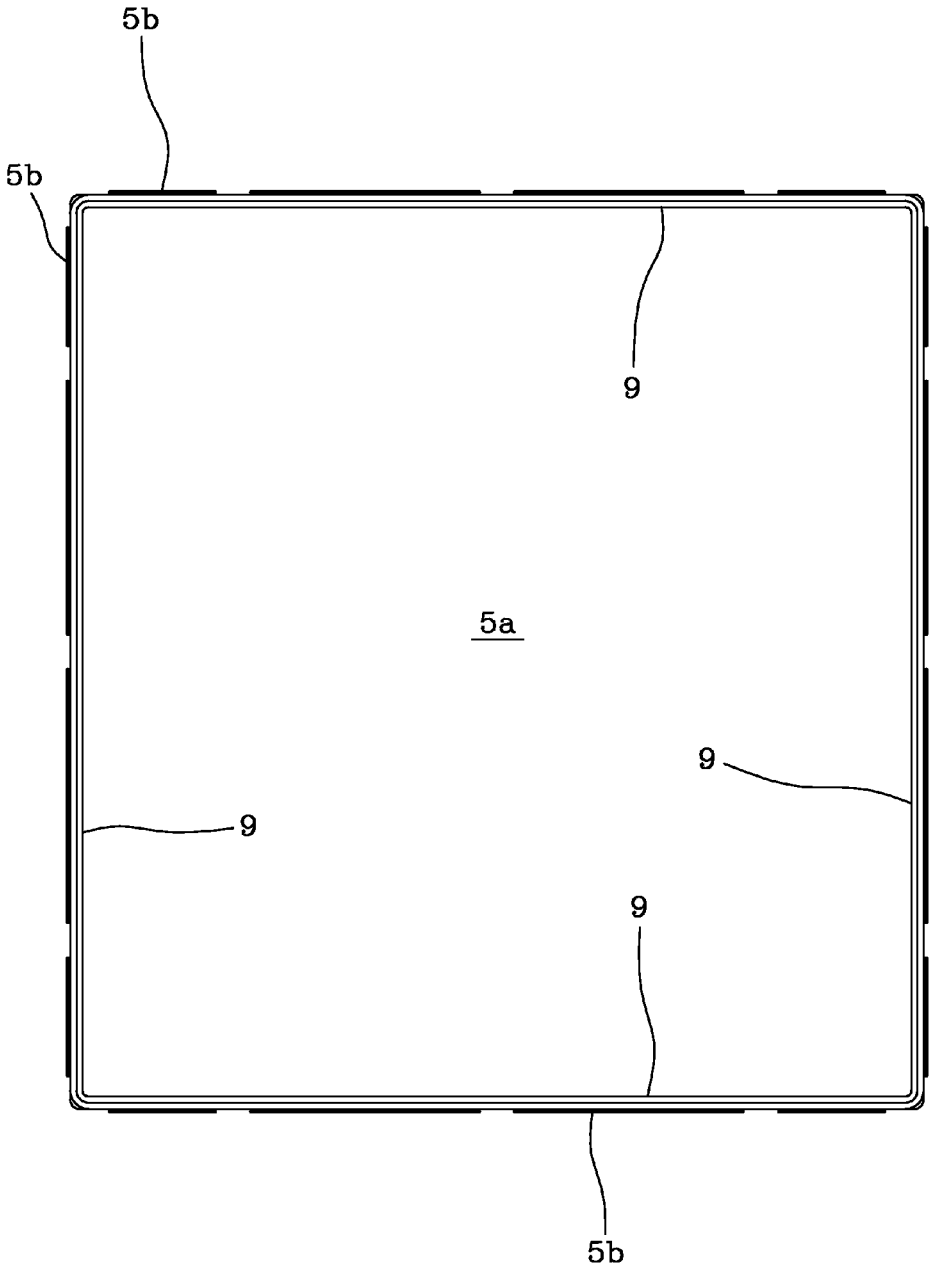
FIG. 11 is a plan view of the element in FIG. 5 from the opposite direction than the one in FIG. 5.
Figure 12:
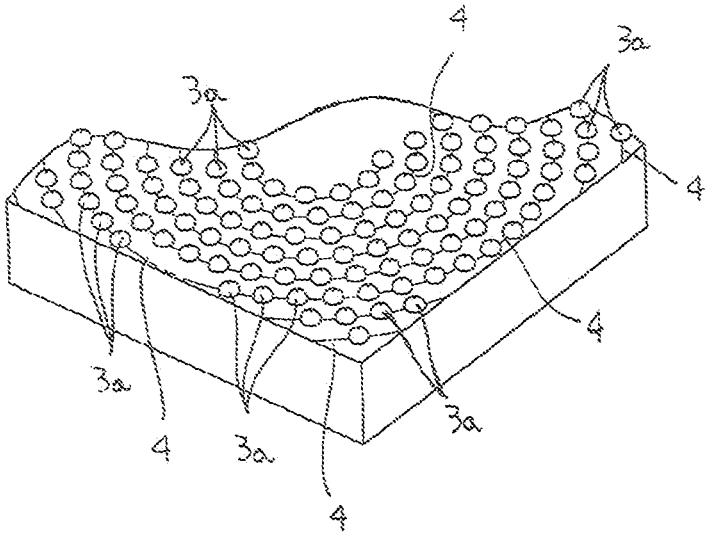
FIG. 12 is a perspective view showing engagement protrusions 3*a* having an at least partly spheroidal configuration.
Figure 13:
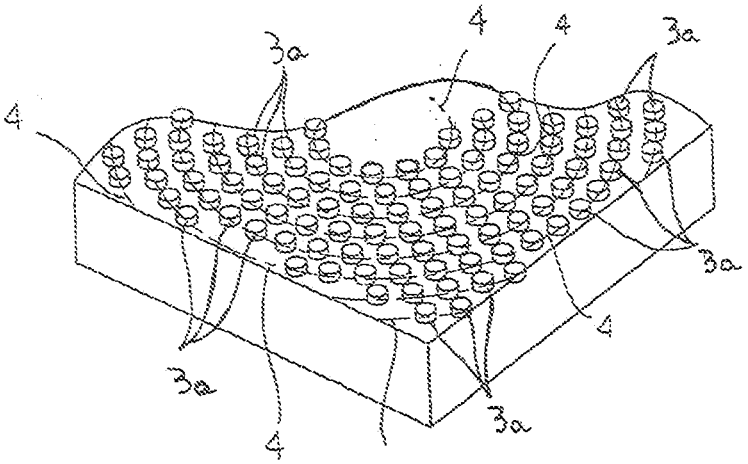
FIG. 13 is a perspective view showing engagement protrusions 3*a* having a cylindrical shape along their extension axis.

From a structural point of view, an upright has at least one and preferably two walls co-operatively defining the cross section shape; these walls in turn have a side edge 6*a* to be given any conformation depending on requirements. In the embodiment shown in FIG. 1 it is possible to see that this side edge 6*a* has a converging-diverging extension in the direction of the longitudinal extension axis of the upright 6; due to this construction architecture, possible intrusions of the upright into the holding volume can be advantageously prevented on occurrence of deformations induced thereon during the handling or storage operations of package 1.

Obviously, the edge 6*a* can have other extensions depending on specific requirements for instance, for obtaining the maximum simplest construction a linear edge preferably parallel to the longitudinal extension axis of the upright 6 can be set.

Advantageously, the package in accordance with the present invention may further comprise shock-resistant means that can be operatively activated within the holding volume and between the package 1 itself and an item contained therein. In other words, the holding volume can accommodate shock-absorbers that are previously coupled with the rigid parts (base elements 5 and uprights 6) forming the package and the task of which is to protect the article of manufacture contained therein. The shock-resistant means 7 can be made of different materials (that in turn can be re-usable materials), such as expanded polypropylene, and can be suitably positioned relative to the uprights and/or base elements.

Operatively, the shock-resistant means 7 enables uncoupling of the article of manufacture to be packaged relative to the "structural shell" consisting of the confining elements 2, so as to cause absorption of the vibrations and kinetic energy that is produced when the packaged item falls or is submitted to impacts as a result of wrong operations.

Should it be necessary (when particularly heavy uses are provided, for example), the present package may comprise additional stiffening means associated with the confining elements 2, such as reinforcing ribs, additional latticeworks and so on; this additional stiffening means will be suitably positioned at the inside and/or outside of the holding volume.

Should the stiffening means be positioned within the confining elements 2 (or in other words, if said means faces the holding volume or are formed in the faces opposite to the interfacing surfaces 2*a*), the means 2*a* can be advantageously used as anchoring means for the shock-resistant means 7; actually, due to the presence of possible ribs (or equivalent structures) at the inside of the confining elements 2, through a suitable conformation of the shock-resistant means 7 (in turn having recesses at least partly matching the shape of said ribs or equivalent means), a steady relative positioning between the elements 2 and shock-absorbers 7 can be maintained.

At the same time it will be appreciated that arrangement of the ribs on the "inner" faces of elements 2 allows a great geometric simplicity of the outer surfaces of package 1 to be obtained, so that these surfaces can be cleaned more easily, are more regular and more suitable for resting on planes or being handled by sliding (without encountering undesirable stoppages).

Still for the purpose of offering more structural coherence (if required), additional confining elements (not shown in the accompanying drawings) can be set and interposed between the confining elements 2 and preferably the uprights 6 at a median point thereof; these additional confining elements can merely consist of cross-pieces extending between two adjacent uprights and can also house suitably disposed and shaped shock-resistant means 7.

To enable the package to be correctly maintained in an assembled condition, the package itself can have housing means designed to receive pulling elements (such as straps or the like); this housing means can be formed in at least one base element 5 and can merely consist of grooves and/or recesses included between two or more sectors 3*d*, through which said straps can be inserted and then tensioned.

With reference to the accompanying drawings, it is possible to see that on the side walls/faces as well as on the outer base wall/face of the base/lid, shallow grooves have been formed for passage of straps or other fastening means.

The present invention can be put into practice using a plurality of different materials, provided the choice of said materials and consequent sizing of the different confining elements (and possible accessory parts) give the desired degree of mechanical performance; taking into account this point of view, one of the basic materials that can be used to accomplish the present type of package is polypropylene, but other plastic, metal or wood materials can give the same satisfactory results being at the same time advantageous from an economical point of view.

The invention achieves important advantages.

First of all, the particular construction architecture of the present package enables two or more packages disposed in mutual side by side and/or piled-up relationship to be maintained efficiently blocked; in fact, due to the presence and geometry of the grip means (that on the other hand can be indiscriminately positioned on different components of the package itself), every possible relative sliding of the packages along the contact plane of same is efficiently prevented.

At the same time, the presence of the grip means 3 enables package 1 to rest optimally on the ground or on the bottom of loading compartments also when non-perfect evenness/cleanness conditions of the bottom itself are present.

In this connection it is to be pointed out that the grip means as herein disclosed and claimed acts in an efficient manner both when several packages are handled by means of jaw lift trucks (and in this case said means enables the different side by side packages to efficiently exchange constraining reactions directed along the vertical planes in mutual side by side relationship) and when several packages are stored upon each other forming several layers (and in this case said means enables constraining reactions to be exchanged both along vertical planes in mutual side by side relationship and along horizontal support planes).

It will be also appreciated that the wide variety of materials that can be used to define the different structural elements of the present package enables high mechanical features to be given to the package itself while at the same time substantially avoiding arising of problems connected with the environmental impact; in fact, due to a prolonged reuse in time of these packages, all problems connected with disposal of packages to be thrown away after use are avoided.

The shape of the different package components susceptible of dismantling is also advantageous in terms of package compactness under disassembled conditions, which has favourable repercussions on the logistic efficiency.

It will be also appreciated that the great simplicity of the different package components offers advantages from an economical point of view; in fact, the present invention enables exploitation of the logistic transportation compartments (railway trucks, lorry trailers or others) and/or storage compartments (warehouses, sheds and so on) to be maximised and, as a result, the logistic costs to be reduced; at the same time, due to the high structural performance of the present package, over-sizing of the goods to be packaged can be avoided; this generally involves an important abatement of all costs, i.e. not only of those connected with logistic problems but also as regards planning and manufacture of the package itself and even of the goods to be packaged therein. It will be finally appreciated that the reduction in the planning and manufacture costs of the package itself is also favourably influenced by the great simplicity of the package structure and great variety of the materials used.

The invention claimed is:

1. A package of returnable and reusable type, comprising:

a plurality of confining elements mutually assembled in a removable manner and defining a holding volume and having at least a first interfacing surface for contacting an interfacing surface of another package when two packages are (a) stacked, (b) flanked, or (c) stacked and flanked, the confining elements being effective (a) to be assembled around an item to be transported from a first location to a second location, (b) when the item reaches the second location, to be disassembled from around the item, and (c) to be subsequently reassembled around a second item to be transported from a third location to a fourth location;

grip means provided on said first interfacing surface, said grip means defining a first directrix and a second directrix, said first directrix comprising a first curvilinear stretch developing along a first path, said second directrix comprising a second curvilinear stretch developing along a second path, said first and second stretches being side by side, said first and second paths being (a) concentric circular paths or (b) concentric elliptic paths, each stretch being defined by a series of individual engagement protrusions which are separate from each other and which are spaced apart along said stretch, each engagement protrusion extending from said first interfacing surface, wherein the grip means are effective to permit a pair of said packages to be engaged via stacking or flanking and then to be lifted in engagement together without slipping relative to each other.

2. A package as in claim 1, wherein each of said engagement protrusions has an extension axis emerging from said first interfacing surface.

3. A package as in claim 2, wherein each of the engagement protrusions has a tapering shape along said extension axis, said tapering shape defining a frusto-conical configuration, a truncated-pyramid configuration or a partly spheroidal configuration.

4. A package as in claim 1, wherein each of the engagement protrusions comprises self-centering means.

5. A package as in claim 4, wherein said self-centering means are integrally formed at least on the engagement protrusions to enable mutual interfacing of the same.

6. A package as in claim 1, wherein each of the engagement protrusions has a cylindrical shape along an extension axis emerging from said first interfacing surface.

7. A package as in claim 1, wherein the grip means further comprises engagement recesses at least partly matching said engagement protrusions and disposed along said directrices.

8. A package as in claim 7, wherein said engagement recesses are in an alternated sequence with the engagement protrusions.

9. A package as in claim 7, wherein said engagement recesses are defined in a space included between two engagement protrusions.

10. A package as in claim 7, wherein the engagement recesses have an extension axis entering said first interfacing surface consisting of a frusto-conical cavity, a cavity in the form of a truncated pyramid or a partly spheroidal cavity.

11. A package as in claim 7, wherein the engagement recesses consist of a cylindrical cavity.

12. A package as in claim 1, wherein the confining elements comprise:

at least one base element having a main wall with an edge; secondary walls emerging from said edge of said main wall; the grip means being formed on an outer surface of (a) said main wall, (b) said secondary walls, or (c) said main wall and said secondary walls.

13. A package as in claim 12, wherein the base element comprises a plurality of sectors having said grip means on the main wall or on at least one secondary wall.

14. A package as in claim 13, wherein said sectors are disposed in correspondence of the edge of the main wall.

15. A package as in claim 1, wherein the package further comprises shock-resistant means activated into the holding volume between the package and an item contained therein.

16. A package as in claim 1, wherein the confining elements comprise additional stiffening means.

17. A package as in claim 1, wherein the confining elements comprise a base element and an upright.

18. The package of claim 1, wherein each of the engagement protrusions has an at least partly spheroidal configuration.

19. The package of claim 1, wherein the first interfacing surface is a vertical surface.

20. The package of claim 1, wherein the first interfacing surface is a horizontal surface.

21. A package of returnable and reusable type, comprising:

a plurality of confining elements mutually assembled in a removable manner and defining a holding volume and having at least a planar vertical first interfacing surface for contacting a planar vertical interfacing surface of another package when two packages are flanked, the confining elements being effective (a) to be assembled around an item to be transported from a first location to a second location, (b) when the item reaches the second location, to be disassembled from around the item, and (c) to be subsequently reassembled around a second item to be transported from a third location to a fourth location;

grip means provided on said first interfacing surface, said grip means defining a first directrix and a second directrix, said first directrix comprising a first stretch developing along a first path, said second directrix comprising a second stretch developing along a second path, said first and second stretches being side by side, each stretch being defined by a series of individual engagement protrusions which are separate from each other and which are spaced apart along said stretch, each engagement protrusion extending from said first interfacing surface, wherein the grip means are effective to permit a pair of said packages to be engaged via flanking and then to be lifted in engagement together without slipping relative to each other.

* * * * *